US010060017B2

(12) United States Patent
Kobayashi et al.

(10) Patent No.: US 10,060,017 B2
(45) Date of Patent: Aug. 28, 2018

(54) METAL SHEET TO BE HEATED BY RADIANT HEAT TRANSFER AND METHOD OF MANUFACTURING THE SAME, AND METAL PROCESSED PRODUCT HAVING PORTION WITH DIFFERENT STRENGTH AND METHOD OF MANUFACTURING THE SAME

(75) Inventors: Yoshifumi Kobayashi, Tokyo (JP); Kazuyuki Kawano, Tokyo (JP); Yasunori Itoh, Tokyo (JP); Shinichi Suzuki, Tokyo (JP); Shintaro Yamanaka, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 244 days.

(21) Appl. No.: 13/261,170

(22) PCT Filed: Aug. 5, 2010

(86) PCT No.: PCT/JP2010/063291

§ 371 (c)(1),
(2), (4) Date: Feb. 3, 2012

(87) PCT Pub. No.: WO2011/016518

PCT Pub. Date: Feb. 10, 2011

(65) Prior Publication Data

US 2012/0135263 A1 May 31, 2012

(30) Foreign Application Priority Data

Aug. 6, 2009 (JP) ..... 2009-183220
Aug. 6, 2009 (JP) ..... 2009-183221

(51) Int. Cl.
*C23C 4/04* (2006.01)
*C21D 8/04* (2006.01)
(Continued)

(52) U.S. Cl.
CPC ..... *C23C 4/04* (2013.01); *C21D 8/0494* (2013.01); *C22C 38/001* (2013.01);
(Continued)

(58) Field of Classification Search
CPC ..... C23C 4/04; C21D 8/04
See application file for complete search history.

(56) References Cited

U.S. PATENT DOCUMENTS 2,731,403 A * 1/1956 Rubin ..... 205/138
3,796,099 A 3/1974 Shimotsuma et al.
(Continued)

FOREIGN PATENT DOCUMENTS

CN 1847337 A 10/2006
DE 19743802 A1 3/1999
(Continued)

OTHER PUBLICATIONS

<http://www.askzn.co.za/tech/tech_grades.htm>, "Stainless Steel Grades and Mechanical Properties", accessed Feb. 24, 2014.*
(Continued)

*Primary Examiner* — Humera N Sheikh
*Assistant Examiner* — Xiaobei Wang
(74) *Attorney, Agent, or Firm* — Birch, Stewart, Kolasch & Birch, LLP

(57) ABSTRACT

On part of a surface of a metal sheet that is to be heated by radiant heat transfer with a near-infrared ray, a region where reflectance for a radiant ray is made lower than that of the original surface of the metal sheet is formed. As reflectance reducing treatment, painting or thermal spraying in a blackish color, plating in a blackish color, treatment for increasing roughness of the surface of the metal sheet, blasting, etching, blackening, surface layer quality changing treatment of the metal sheet, or the like can be adopted. The metal sheet is turned into a heated metal sheet partially having a different
(Continued)

temperature by being heated by radiant heat transfer, and thereafter, the heated metal sheet is subjected to thermal processing accompanied by cooling, for example, by hot stamping.

5 Claims, 6 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |
| ***C23C 4/18*** | (2006.01) |

(52) U.S. Cl.
CPC ..... *C22C 38/002* (2013.01); *C22C 38/02* (2013.01); *C22C 38/04* (2013.01); *C22C 38/06* (2013.01); *C22C 38/14* (2013.01); *C23C 4/18* (2013.01); *C21D 2221/00* (2013.01); *Y10T 428/12229* (2015.01)

(56) References Cited

U.S. PATENT DOCUMENTS

| | | | | |
|---|---|---|---|---|
| 5,972,134 | A | 10/1999 | Buschsieweke et al. | |
| 6,321,573 | B1 * | 11/2001 | Fritsche et al. | 65/421 |
| 7,842,142 | B1 * | 11/2010 | Kusumi | C21D 1/673 148/531 |
| 2002/0104591 | A1 | 8/2002 | Gehringhoff et al. | |
| 2003/0026990 | A1 * | 2/2003 | Yamada et al. | 428/408 |
| 2005/0282033 | A1 * | 12/2005 | Nakamaru et al. | 428/623 |
| 2006/0130940 | A1 * | 6/2006 | Kollaritsch et al. | 148/518 |
| 2007/0261769 | A1 * | 11/2007 | Bodin | 148/559 |
| 2008/0257404 | A1 * | 10/2008 | Schuisky et al. | 136/255 |
| 2010/0221549 | A1 * | 9/2010 | Shigekuni | B05D 7/14 428/412 |

FOREIGN PATENT DOCUMENTS

| | | | | | |
|---|---|---|---|---|---|
| DE | 10162415 | A1 | | 7/2003 | |
| JP | 63-116010 | | | 5/1988 | |
| JP | 10-202326 | | | 8/1998 | |
| JP | 2002-018533 | | | 1/2002 | |
| JP | 2002-18533 | | | 1/2002 | |
| JP | 2004-55265 | | | 2/2004 | |
| JP | 2004-218016 | | | 8/2004 | |
| JP | 2004218016 | | | 8/2004 | |
| JP | 2004-315927 | | * | 11/2004 | C22C 38/00 |
| JP | 2004315927 | | | 11/2004 | |
| JP | 2005-330504 | | | 12/2005 | |
| JP | 2006-289425 | | | 10/2006 | |
| JP | 2006-306211 | | | 11/2006 | |
| JP | 2008-240047 | | | 10/2008 | |
| JP | 2008240047 | | | 10/2008 | |
| JP | 2009-61473 | | | 3/2009 | |
| WO | WO 2006/016681 | A1 | | 2/2006 | |
| WO | WO2006/030971 | | * | 3/2006 | B21D 28/00 |

OTHER PUBLICATIONS

English machine translation of DE 19743802, accessed Mar. 14, 2017, EPO.*

International Search Report dated Nov. 9, 2010 issued in corresponding PCT Application No. PCT/JP2010/063291.

International Preliminary Report on Patentability dated Mar. 22, 2012 issued in corresponding PCT Application No. PCT/JP2010/063291.

Extended European Search Report dated May 20, 2016, issued in corresponding European Patent Application No. 10806517.8.

Third Party Observations by Association Remora for European Application No. 10806517.8, mailed Jun. 20, 2016, with an English Translation thereof.

* cited by examiner

METAL SHEET TO BE HEATED BY RADIANT HEAT TRANSFER AND METHOD OF MANUFACTURING THE SAME, AND METAL PROCESSED PRODUCT HAVING PORTION WITH DIFFERENT STRENGTH AND METHOD OF MANUFACTURING THE SAME

TECHNICAL FIELD

The present invention relates to a metal plate to be heated by radiant heat transfer excellent in workability and a method of manufacturing the same, and a metal processed product having a portion with different strength and a method of manufacturing the same. This application is a national stage application of International Application No. PCT/JP2010/063291, filed Aug. 5, 2010, which claims the benefit of priority of the prior Japanese Patent Application No. 2009-183220, filed on Aug. 6, 2009 and Japanese Patent Application No. 2009-183221, filed on Aug. 6, 2009; the entire contents of which are incorporated herein by reference.

BACKGROUND ART

Many mechanical components such as automobile structural components are manufactured through pressing of a steel sheet or other metal sheets. However, products obtained through ordinary cold press forming have a problem that spring back is likely to occur therein due to an intrinsic stress and dimensional accuracy thereof is not stable. As one method to solve this problem, hot pressing called hot stamping has been drawing attention. This hot stamping is a forming method in which a steel sheet heated to a predetermined temperature in advance is press-formed and is quenched in a press die to be hardened. The use of this method prevents the occurrence of the spring back and enables the manufacture of a formed product high in dimensional accuracy and strength.

To perform the hot stamping, it is necessary to heat a steel sheet in advance up to a temperature range at which its metal structure becomes an austenite single phase. As a heating method, a gas heating furnace or the like is generally used, but the gas heating furnace or the like is poor in productivity because of its low heating efficiency. Therefore, to increase productivity, the facility needs to be made large, leading to increased cost. Therefore, as a heating method that can increase productivity, an electrify heating as disclosed in Patent Literature 1 has been proposed. This electrify heating is a method of heating a metal sheet by a Joule heat by passing a current through the metal sheet by bringing electrodes into contact with both ends of the metal sheet, and it has an advantage of wasting less energy and being capable of quick heating. However, when the shape of the metal sheet is not a square but a profile shape, the current concentrates on a portion with a small sectional area, which has a problem that a desired region cannot be uniformly heated. Incidentally, to uniformly heat a specific portion of the metal sheet, laser heating is conceivable, but this has problems of high facility cost and poor productivity.

CITATION LIST

Patent Literature

Patent Literature 1: Japanese Laid-open Patent Publication No. 2004-55265

Patent Literature 2: Japanese Laid-open Patent Publication No. 2006-306211

Patent Literature 3: Japanese Laid-open Patent Publication No. 2005-330504

Patent Literature 4: Japanese Laid-open Patent Publication No. 2006-289425

Patent Literature 5: Japanese Laid-open Patent Publication No. 2009-61473

SUMMARY OF INVENTION

Technical Problem

Therefore, a first object of the present invention is to provide a metal sheet to be heated by radiant heat transfer that can be easily heated to a desired temperature even when surface reflectance of the metal sheet is high and a method of manufacturing the same.

A second object of the present invention is to provide a metal processed product having a portion with different strength that can be manufactured at low cost and with high productivity and has little restriction on the disposition of the portion with different strength and a method of manufacturing the same.

Solution to Problem

A metal sheet to be heated by radiant heat transfer according to the present invention is characterized in that, on part of a surface of the metal sheet to be heated by radiant heat transfer, a reflectance-reduced region lower in reflectance for a radiant ray than the surface of the metal sheet is formed. Further, the metal sheet can be a plated steel sheet.

Further, a method of manufacturing a metal sheet to be heated by radiant heat transfer according to the present invention is characterized in that part of a surface of the metal sheet to be heated by radiant heat transfer is subjected to reflectance reducing treatment so as to have reflectance for a radiant ray lower than that of the original surface of the metal sheet.

As the reflectance reducing treatment, painting, roughening by blasting, rolling, laser, or the like, metal coating by plating or thermal spraying, coloring and etching by immersion in an acid solution, surface layer quality changing treatment, and the like can be employed, but it is not limited to these methods. Note that the reflectance reducing treatment is preferably treatment in a blackish color. In any of the cases, the reflectance is 40% or less, preferably 30% or less, more preferably 25% or less.

Further, a metal processed product having a portion with different strength according to the present invention is characterized in that a portion where reflectance for a radiant ray is reduced is partially formed on a surface of the metal processed product, and a difference in Vickers hardness between the portion where the reflectance for the radiant ray is reduced and the other portion is HV180 or more, preferably HV200 or more.

Further, a method of manufacturing a metal processed product having a portion with different strength according to the present invention is characterized in that a region where reflectance for a radiant ray is reduced is formed on part of a surface of a metal sheet by metal surface treatment or surface layer quality changing treatment, the metal sheet is turned into a heated metal sheet partially having a different temperature by being heated by radiant heat transfer, and the heated metal sheet is subjected to thermal processing accompanied by cooling.

In the present invention, as the treatment for forming the region where the reflectance for the radiant ray is reduced on part of the surface of the metal sheet, usable are painting, roughening by blasting, rolling, laser, or the like, metal coating by plating or thermal spraying, coloring and etching by immersion in an acid solution, surface layer quality changing treatment, and the like, but it is not limited to these methods.

Further, in the present invention, the thermal processing accompanied by cooling can be, for example, hot stamping, and also can be quenching.

Advantageous Effects of Invention

According to the present invention, it is possible to increase heating efficiency and to intensively heat only a specific portion of a metal sheet by radiant heat transfer at lower cost and with higher productivity than conventionally. Moreover, there are many advantages such as a higher degree of freedom in component design as a metal processed product.

DESCRIPTION OF EMBODIMENTS

Hereinafter, an embodiment of the present invention will be described with reference to the attached drawings.

(Manufacture of Metal Sheet to be Heated by Radiant Heat Transfer)

Figure 1:
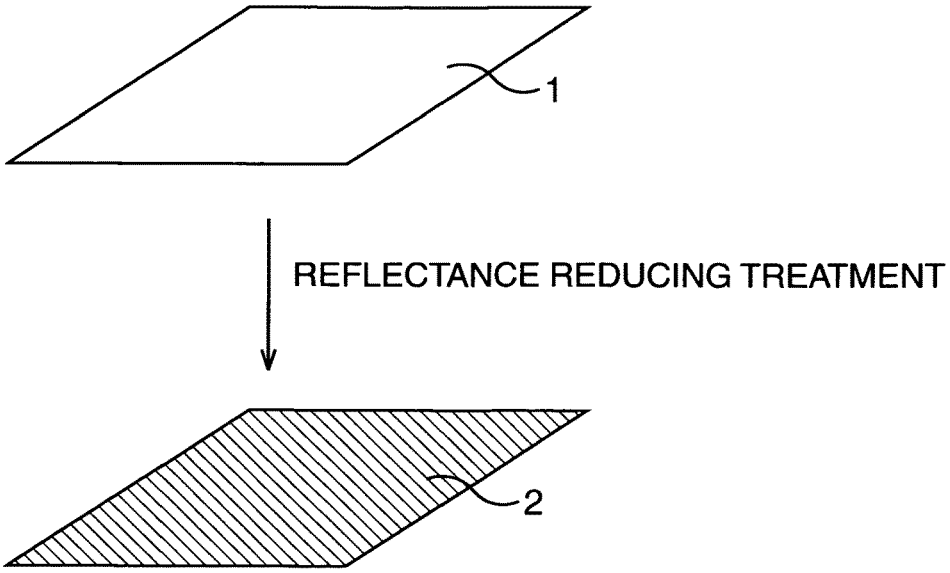
FIG. 1 is perspective view showing an example of a metal sheet entirely subjected to reflectance reducing treatment.
Figure 2:
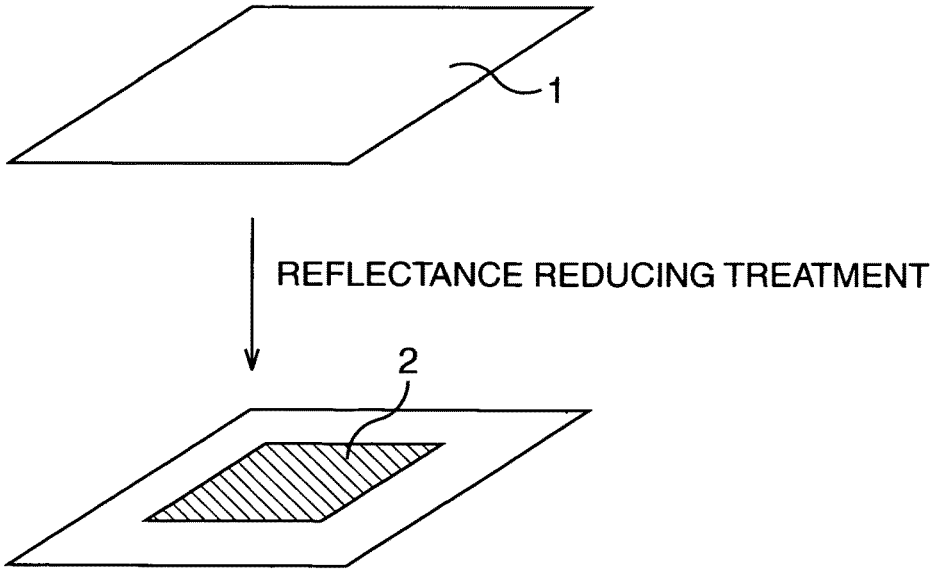
FIG. 2 is a perspective view showing an example of a metal sheet partly subjected to the reflectance reducing treatment.

FIG. 1 is a view showing a metal sheet 1 whose whole surface is a reflectance-reduced region 2, and FIG. 2 is a view showing a metal sheet whose surface is partly a reflectance-reduced region 2.

As shown in FIG. 1 and FIG. 2, in this embodiment, reflectance reducing treatment is applied on the surface of the metal sheet 1 to form the reflectance-reduced region 2. The metal sheet 1 is a metal sheet that is to be hot-stamped in a later step, and is heated by radiant heat transfer with a near-infrared ray or the like immediately before hot-stamped.

The kind of the metal sheet 1 is not particularly limited, but typical metal sheets to be hot-stamped are hot-rolled steel sheets, cold-rolled steel sheets, and plated steel sheets. Here, the plated steel sheets include steel sheets having undergone hot-dip galvanizing, alloying hot-dip galvanizing, electrogalvanizing, alloying electrogalvanizing, hot-dip aluminum plating, or plating with a zinc alloy containing Al, Mg, Si, Cr, Ni, or the like, but the plated steel sheet is not limited to any of these, provided that it is usable for hot stamping.

Conventionally, when a shape of a metal sheet is not a square but a profile shape, it has not been possible for electrify heating to uniformly heat the whole metal sheet because a current concentrates on its portion with a small sectional area. Therefore, the present inventor experimented a method of heating a metal sheet made of metal to a desired temperature by radiant heat transfer heating using a near-infrared lamp with a 0.7 to 2.5 μm wavelength. This method can uniformly heat the whole metal sheet. However, many of metal sheets used as automobile structural components and the like are hot-rolled steel sheets, cold-rolled steel sheets, or plated steel sheets having undergone galvanizing or aluminum plating, and heating them by radiant heat transfer is extremely low in heating efficiency because most of the near-infrared ray is reflected on a surface of the metal sheet.

The present inventor cut a hot-dip galvanized steel sheet which had a composition containing C: 0.22 mass %, Si: 0.15 mass %, Mn: 2.0 mass %, P: 0.02 mass % or less, S: 0.005 mass % or less, Ti: 0.023 mass %, Al: 0.035 mass %, B: 15 ppm, and N: 20 ppm, with the balance being Fe and inevitable impurities and had a 1.6 mm sheet thickness, into a shape with a 170 mm short side and a 440 mm long side, heated the resultant by radiant heat transfer from 20° C. to 850° C. by using a near-infrared lamp, and measured a temperature of the steel sheet. In this case, because of high reflectance for the near-infrared ray, a temperature increasing rate was 30° C./second, but in a hot-rolled steel sheet subjected to electrify heating under the same condition, a temperature increasing rate was 58° C./second. Thus, when the hot-dip galvanized steel sheet is heated by radiant heat transfer using the near-infrared ray, the temperature increasing rate is very low, resulting in high heating cost, low heating rate, and poor productivity.

Further, the present inventor experimented a method in which a metal sheet was heated to a high temperature only at its specific portion and was hot-stamped, whereby a molded product was locally hardened. However, it is not easy for either of electrify heating or heating by radiant heat transfer to intensively heat an arbitrary portion in the metal sheet. In such a case, spot heating by a laser beam is performed, but the laser heating has problems of requiring high facility cost and being poor in productivity. Therefore, there has been a demand for a technique capable of heating a specific portion of a metal sheet at low cost and with high productivity.

Therefore, in this embodiment, a surface of such a high-reflectance metal sheet 1 is subjected to reflectance reducing treatment for making reflectance for a radiant ray such as a near-infrared ray lower than that of the original surface of the metal sheet 1. As concrete methods of the reflectance reducing treatment, usable are painting, roughening by blasting, rolling, laser, or the like, metal coating by plating or thermal spraying, coloring and etching by immersion in an acid solution, surface layer quality changing treatment, and the like, but the method is not limited to these methods. Note that the reflectance reducing treatment may be applied only on one surface of the metal sheet or may be applied on both front and rear surfaces thereof. Further, in order to improve heating efficiency, it is preferable that the reflectance of the reflectance-reduced region 2 is 40% or less, preferably 30% or less, more preferably 25% or less. Incidentally, the reflectance was measured in the following manner. Specifically, by using a spectrophotometer UV-3100PC and a multi-purpose large sample chamber MPC-3100 which are manufactured by Shimadzu, baseline correction within 2400 to 300 nm was done using $BaSO_4$ manufactured by Merck & Co., Ltd., thereafter, a sample material was set, and a total reflection spectrum including diffuse reflection was measured at an 8-degree incident angle. The reflectance corresponding to a wavelength of the obtained total reflection spectrum was defined as the reflectance in the present invention.

The painting in a blackish color is a method of reducing the reflectance by painting the surface of the metal sheet 1 with an organic or inorganic blacking. Note that the color need not be complete black but may be a blackish color. This method can be easily implemented only with a roller or a spray gun. Further, appropriate masking enables the easy painting of only an arbitrary portion of the metal sheet 1, but the use of a stamping method makes it possible to easily paint an arbitrary portion of the metal sheet 1 without masking. Further, in the painting in a blackish color, for example, after degreasing the surface of the metal sheet by alcohol or the like, the surface of the metal sheet can be painted with, for example, Aqua-Black manufactured by Tokai Carbon.

The roughening of the surface of the metal sheet is a method of reducing the reflectance by shot blasting or rolling each being a mechanical method, or by laser. Further, in any of the cases, appropriate masking enables the roughening of only an arbitrary portion of the metal sheet 1 to reduce the reflectance. In the case of the method using laser, only an arbitrary portion may be irradiated with laser without masking to be roughened.

In the shot blasting, a blast #24, 40, 60 80 is used, for instance, and in the rolling, roughness of a reduction roll is adjusted according to ability of a used rolling mill. In the method using laser, there is no restriction on which of transmitters of $CO_2$, YAG, fiber, and the like is to be used, and the formed irregularities can be in a lattice form, a stripe form, or a dot-sequence form. It is preferable that the irregularities are formed so that surface roughness Ra is, for example, 0.6 μm or more, preferably 0.8 μm or more.

The coating in a blackish color is a method of reducing the reflectance by, for example, black electroless nickel coating. Further, appropriate masking enables the plating of only an arbitrary portion of the metal sheet 1 to Substitute Specification reduce the reflectance.

The thermal spraying in a blackish color is a method of reducing the reflectance by plasma-spraying a blackish substance such as, for example, an $Al_2O_3$—$TiO_2$-based thermal spray material. Note that the color need not be complete black and may be blackish color. Further, appropriate masking enables the easy thermal spraying to only an arbitrary portion of the metal sheet 1 to reduce the reflectance.

The coloring by the immersion in the acid solution is a method of reducing the reflectance by blackening with, for example, an oxalic acid aqueous solution. Further, appropriate masking enables the treatment of only an arbitrary portion of the metal sheet 1 to reduce the reflectance.

The chemical etching is a method of reducing the reflectance by, for example, a method of 10-second immersion in a 10% HCl aqueous solution at 25° C., followed by water-washing and drying. Further, appropriate masking enables the treatment of only an arbitrary portion of the metal sheet 1 to reduce the reflectance.

The surface layer quality changing treatment is a method of reducing the reflectance by a blackening method of 5-second immersion in a 10% nickel chloride hexahydrate aqueous solution at a 60° C. temperature, followed by water-washing and drying. Further, appropriate masking enables the treatment of only an arbitrary portion of the metal sheet 1 to reduce the reflectance.

(Manufacture of Processed Metal Product Having Portion with Different Strength)

Figure 3:
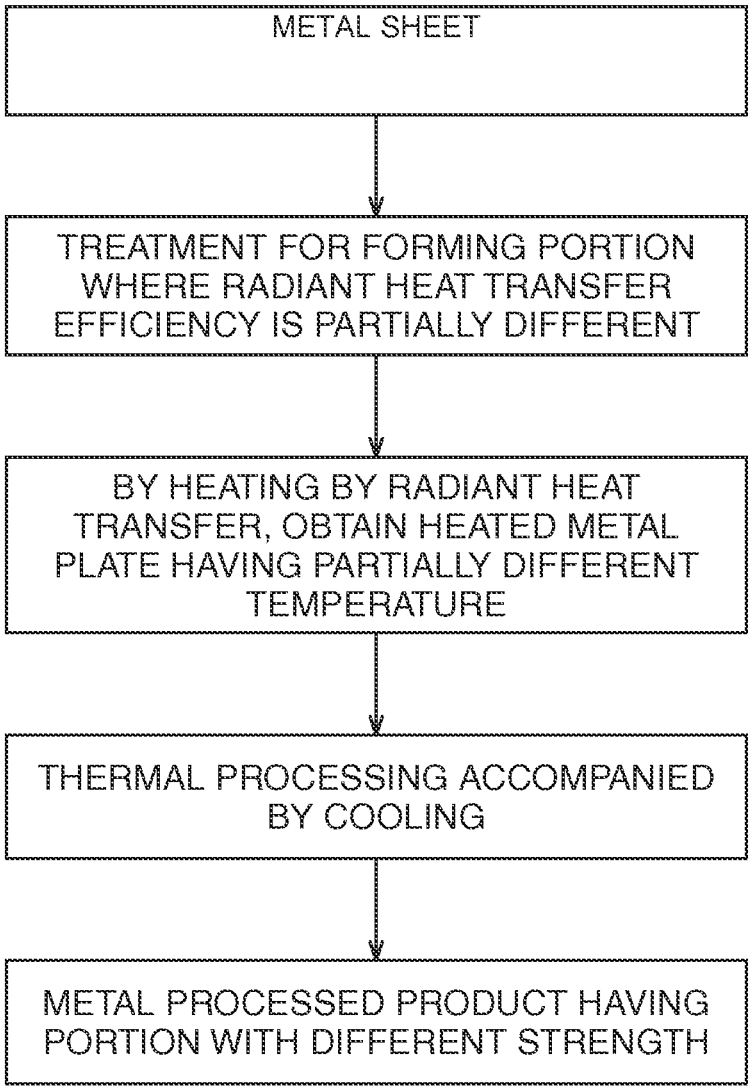
FIG. 3 is a chart showing steps of manufacturing a metal processed product of the present invention.

Automobile structural components and the like are sometimes required to have high strength at their portions where a load is applied and not to have high strength at the other portions in consideration of weldability. Contrarily, they are sometimes required to have low strength only at their specific portions. A metal processed product having such a portion with different strength can be manufactured through the procedure shown in FIG. 3 by using a metal sheet 11 in which a reflectance-reduced region is formed in this embodiment described above. Incidentally, the metal sheet 11 can be also obtained in the following method, instead of applying the reflectance reducing treatment to a metal sheet obtained as a result of cutting or punching by a press. First, before performing cutting or punching by the press, the reflectance reducing treatment is applied on a surface of a metal material such as a steel strip to form in advance a portion where radiant heat transfer efficiency is partially different. Then, it may be formed into the metal sheet 11 by cutting or punching by a press. Further, in the example shown in FIG. 4, a boundary of the reflectance-reduced region is clear, but it is also possible to form the reflectance-reduced region so as to continuously change radiant heat transfer efficiency. In this case, level of the reflectance reducing treatment is continuously changed or a treatment thickness in a sheet thickness direction is continuously changed.

Next, the metal sheet 11 having undergone the reflectance reducing treatment is irradiated with, for example, a near-infrared ray (wavelength 0.7 to 2.5 μm), a mid-infrared ray (wavelength 2.5 μm to 4 μm), or a far-infrared ray (wavelength 4 μm to 1 mm), so that the whole metal sheet 11 is uniformly heated by radiant heat transfer. As a radiant heat transfer heating apparatus generating the near-infrared ray, the mid-infrared ray, or the far-infrared ray, available are a gas heating furnace, an electric heating furnace, an ordinary heating apparatus including an infrared lamp or an infrared heater, a near-infrared lamp, a near-infrared heater, and the like. Consequently, a center portion 12 where the reflectance is reduced and thus radiant heat transfer efficiency is high is quickly heated. On the other hand, in the other peripheral edge portion 13, the reflectance is high and the radiant heat transfer efficiency is low, and thus a heating rate is low. As a result, a heated metal sheet in which the center portion 12 has a high temperature and the peripheral edge portion 13 has a relatively low temperature is obtained. Incidentally, when the heated metal sheet is hot-stamped, a temperature of the high-temperature portion is increased up to a value equal to or higher than a temperature at which a metal structure of the steel material transforms to an austenite single phase, but a temperature of the low-temperature portion is preferably kept at a temperature at which the transformation to the austenite single phase is not completed.

A spectrum amount occupying a 2.5 μm wavelength or more in ordinary mid-infrared heating or far-infrared heating is about 50%. On the other hand, in the near-infrared heating, a spectrum amount is about 90% and thus a high energy density can be obtained, and therefore the near-infrared heating is more preferable as a heating method capable of high-speed heating. The high-speed heating with the near-infrared ray produces a great effect of a reflectance difference of the metal sheet 11 and facilitates causing the metal sheet 11 to have a temperature difference. On the other hand, heating by a gas heating furnace, an electric heating furnace, an infrared lamp, or an infrared heater can reduce the temperature difference of the metal sheet 11.

Next, the obtained heated metal sheet is subjected to thermal processing accompanied by cooling. This may be simple quenching, but is preferably hot stamping. The hot stamping is a processing method of performing quenching inside a shaping die, and is capable of pressing with extremely small warpage and spring back. When such thermal processing accompanied by cooling is performed, the center portion 12 whose temperature is increased up to the value equal to or higher than the temperature at which the metal structure of the steel material transforms to the austenite single phase is quenched to have remarkably high strength, and the peripheral edge portion 13 in which the transformation to the austenite single phase has not been completed has substantially the original strength.

Figure 5:
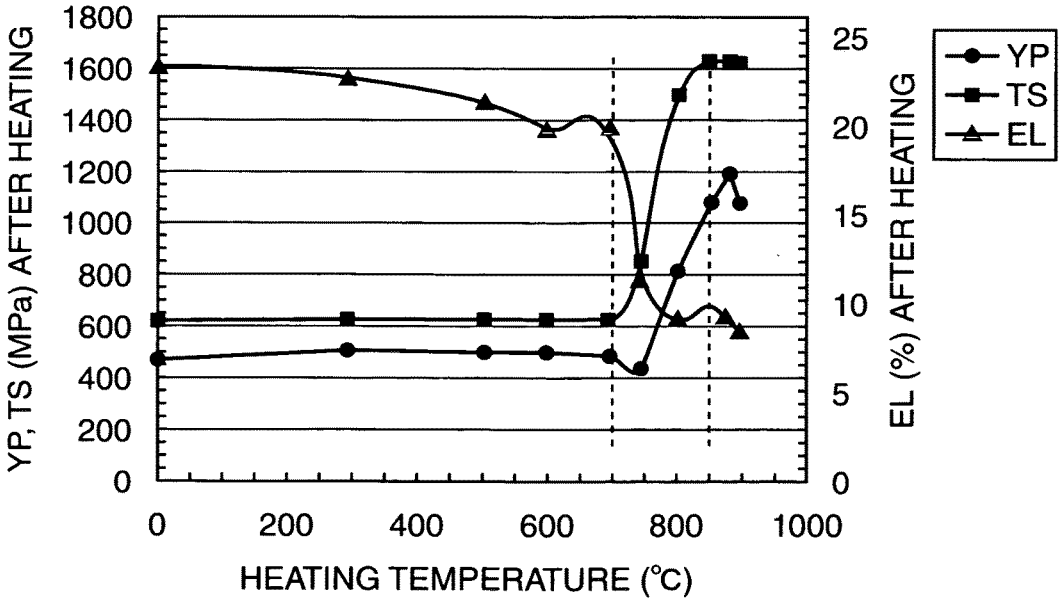
FIG. 5 is a characteristic chart showing a correlation of heating temperature with a yield point, tensile strength, and elongation percentage after quenching.

FIG. 5 is a chart showing a correlation of the temperature of a heated metal sheet before the hot stamping is started, with YP (yield strength), TS (tensile strength), and EL (elongation percentage) after the quenching by the hot stamping is finished. Note that the metal sheet is a steel sheet having a composition containing C: 0.22 mass %, Si: 0.15 mass %, Mn: 2.0 mass %, P: 0.02 mass % or less, S: 0.005 mass % or less, Ti: 0.023 mass %, B: 15 ppm, Al: 0.035 mass %, and N: 50 ppm or less, with the balance being Fe and inevitable impurities, and its tensile strength at room temperature (hereinafter, simply strength) is 600 MPa. As shown in FIG. 5, when the quenching by the hot stamping is performed after the heating up to 800 to 900° C. at which the metal structure transforms to the austenite single phase, the strength remarkably improves up to 1550 MPa. Incidentally, when the heating temperature is set to 700° C. or less at which the transformation into the austenite signal phase is not completed, even with the quenching by the hot stamping, no strength improvement is recognized.

Therefore, if the center portion 12 of the heated metal sheet is set to a temperature equal to or larger than the temperature at which the metal structure transforms to the austenite single phase and the peripheral edge portion 13 is set to the temperature at which the transformation into the austenite single phase is not completed, only the center portion 12 can have high strength and the peripheral edge portion 13 can have the original strength, which makes it possible to obtain a metal processed product having a portion with different strength in which a difference in Vickers hardness is HV180 or more, preferably HV200 or more. This metal processed product has high strength at the center portion 12 receiving a load and has the original strength at the peripheral edge portion 13 requiring weldability, and thus is suitably used as automobile components. As described above, according to this embodiment, it is possible to easily manufacture a metal processed product having a portion with different strength.

Figure 6:
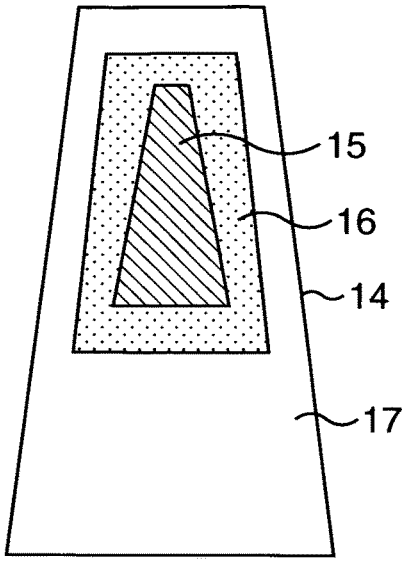
FIG. 6 is a front view showing an example of a metal processed product having a portion with different strength.

Further, as previously described, by continuously changing the level of the reflectance reducing treatment or continuously changing the treatment thickness in the sheet thickness direction, it is possible to continuously change radiant heat transfer efficiency in a horizontal direction. Accordingly, a heating rate also changes and therefore, it is possible to obtain continuous temperature distribution when the heating is finished. For example, as shown in FIG. 6, in a metal sheet 14 being a galvanized steel sheet, a thickness of the reflectance reducing treatment of a center portion 15 is made large, the treatment thickness of a peripheral portion 16 is made smaller than that of the center portion 15, and the reflectance reducing treatment is not applied to a peripheral edge portion 17. Then, the center portion 15 is heated to a temperature equal to or higher than the temperature at which the metal structure transforms to the austenite single phase, so that the peripheral portion 16 has a temperature near the temperature at which the transformation to the austenite single phase takes place and the peripheral edge portion 17 has a temperature at which the transformation into the austenite single phase is not completed. Consequently, it is possible to obtain a metal processed product having portions with different strength in which the center portion 15 has the highest strength, the peripheral portion 16 is lower in strength than the center portion 15 but is higher in strength than the peripheral edge portion 17, and the peripheral edge portion 17 has the original strength. This metal processed product has the highest strength at the center portion 15 receiving the highest load, has high strength at the peripheral portion 16 receiving the next highest load, and has the original strength at the peripheral edge portion 14 requiring weldability and thus is suitably used as automobile components. As described above, according to this embodiment, it is possible to easily manufacture a metal processed product having portions with continuously different strength.

Figure 4:
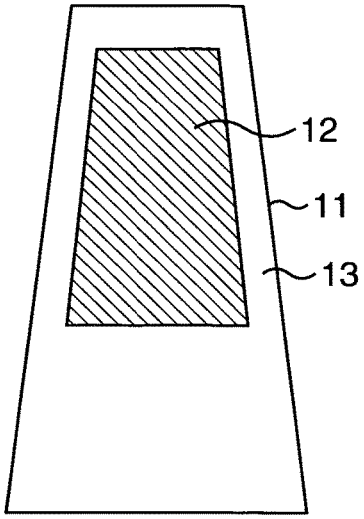
FIG. 4 is a front view showing an example of a metal sheet before it is thermally processed into a metal processed product having a portion with different strength.
Figure 7:
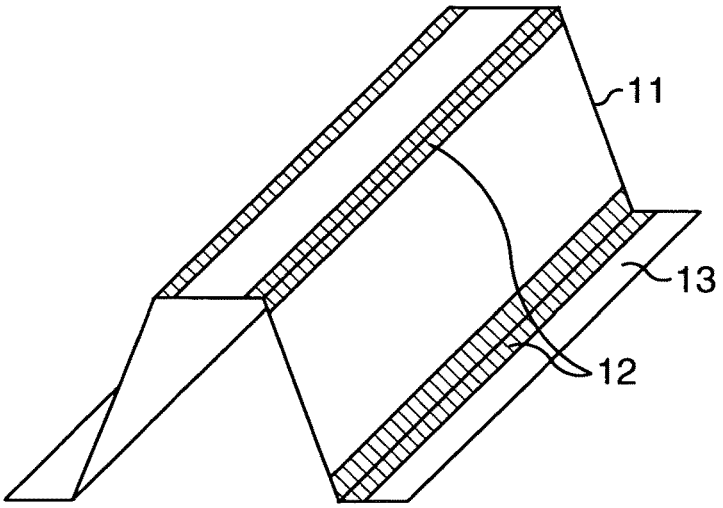
FIG. 7 is a perspective view showing a modification example of the present invention.
Figure 8:
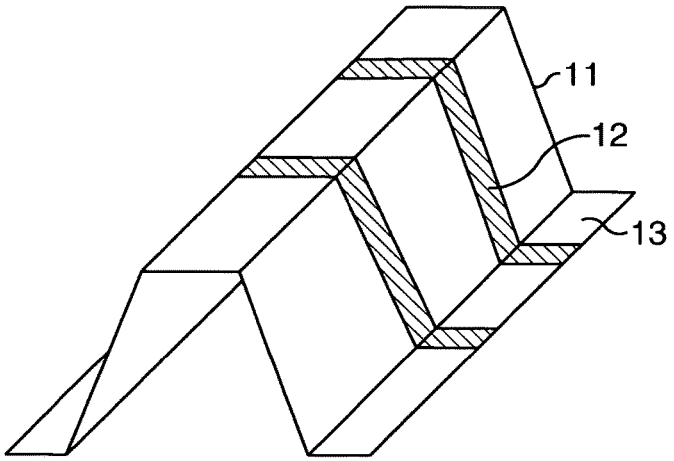
FIG. 8 is a perspective view showing another modification example of the present invention.

Note that the disposition of the portion with different strength is arbitrary, and the portion with different strength may be disposed at a position other than the positions such as the center portion 12 of the metal sheet 11 shown in FIG. 4, and the center portion 15 and the peripheral portion 16 of the metal sheet 14 shown in FIG. 6. For example, as shown in FIG. 7, bending positions may be portions with different strength so that the bended portions are strengthened, or the portion with different strength may be formed in a band shape as shown in FIG. 8.

Advantages of the method of the present invention as compared with a conventional method are summarized as follows.

As compared with a tailored blank method in which, after metal sheets of different kinds are welded in advance to fabricate a tailored metal sheet, the tailored metal sheet is processed, and different strength is partially imparted, the method according to this embodiment does not require preliminary processing of the metal sheet and welding and does not need to use a plurality of kinds of materials. Accordingly, manufacturing cost is low. Further, in the tailored blank method, there is restriction on the position and number of weld lines that are to be strength-changed portions, but in this embodiment, there is no such restriction, and by performing the reflectance reducing treatment with masking at an arbitrary position, it is possible to form a portion with different strength in an arbitrary shape at an arbitrary position.

Further, as compared with a selective quenching method before component forming or after component molding, the number of steps is smaller and facility expense is lower and therefore manufacturing cost becomes lower. Further, a degree of freedom in the shape and disposition of a portion with different strength is larger than that of the selective quenching method.

As described above, according to this embodiment, since it is possible to strengthen only a portion requiring strength in a single component, there is no need to strengthen the whole component, which makes it possible to reduce the weight of the component. Further, since a portion whose strength is not increased can be provided in a single component, welding with other components is facilitated. Further, since warm forming or hot forming is used, there is also an advantage that a degree of freedom in a component shape can be high and warpage and spring back can be reduced.

Example 1

Table 1 summarizes effects obtained when the reflectance reducing treatment according to the present invention was applied to a metal sheet. A steel sheet with a 1.6 mm sheet thickness was cut into a shape with a 170 mm short side and a 440 mm long side and was heated by radiant heat transfer from 20° C. to 850° C. by using a near-infrared lamp. A heating rate was found from a ratio between a temperature difference from 20° C. to 850° C. and the time required for heating. No. 1 to 10 are examples and No. 11 and others are comparative examples.

TABLE 1

| No. | metal sheet | kind of reflectance reducing treatment | concrete treatment contents | reflectance (%) | heating rate (° C./sec) |
|---|---|---|---|---|---|
| 1 | hot-dip galvanizing steel sheet | painting | apply aqueous solution containing carbon black subjected to hydrophilic treatment (Aqua-Black of Tokai Carbon) | 13 | 40 |
| 2 | hot-dip galvanizing steel sheet | metal coating by plating | black electroless nickel plating | 13.5 | 38 |
| 3 | hot-dip galvanizing steel sheet | roughening | shot blast (Ra = 0.8 μm) | 40 | 23 |
| 4 | hot-dip galvanizing steel sheet | painting | apply polyester/melamine-based paint containing carbon powder | 13.9 | 37 |
| 5 | hot-dip galvanizing steel sheet | painting | apply polyester/melamine-based paint containing aluminum nitride powder | 17 | 35 |
| 6 | hot-dip galvanizing steel sheet | painting | apply polyester/melamine-based paint containing ferrosilicon | 15 | 34 |
| 7 | hot-dip galvanizing steel sheet | painting | apply polyester/melamine-based paint containing iron oxide powder | 16 | 35 |
| 8 | hot-dip galvanizing steel sheet | surface layer quality changing | immerse in nickel chloride hexahydrate aqueous solution at 60° C. temperature and with 10% concentration | 13.2 | 41 |
| 9 | hot-dip galvanizing steel sheet | etching by immersion in acid solution | immerse in hydrochloric acid aqueous solution at 25° C. temperature and with 10% concentration | 33 | 23 |
| 10 | hot-dip galvanizing steel sheet | metal coating by thermal spray | plasma-spray $Al_2O_3$—$TiO_2$-based thermal spray material | 20 | 30 |
| 11 | cold-rolled steel sheet (no plating) | no treatment | — | 63 | 20 |
| 12 | hot-rolled steel sheet (no plating) | no treatment | — | 57 | 22 |
| 13 | alloying hot-dip galvanneal steel sheet | no treatment | — | 58 | 21 |
| 14 | hot-dip galvanneal steel sheet | no treatment | — | 70 | 17 |

TABLE 1-continued

| No. | metal sheet | kind of reflectance reducing treatment | concrete treatment contents | reflectance (%) | heating rate (° C./sec) |
|---|---|---|---|---|---|
| 15 | hot-dip aluminum coating steel sheet | no treatment | — | 73 | 11 |

Further, in the present invention, it is possible to form the reflectance-reduced region 2 only in a specific portion of the metal sheet 1 by masking as shown in FIG. 2.

As described above, according to the present invention, it is only necessary to form the reflectance-reduced region 2 only in a specific portion of the metal sheet 1 and heat the metal sheet 1 by radiant heat transfer, and therefore, as compared with laser heating, it is possible to obtain a formed component partially having different strength without any increase in facility cost and with high productivity. As compared with a conventional tailored blanked component, there are many advantages that it can be fabricated at low cost, a portion with different strength can be freely disposed, and only a material of a single kind is needed.

Example 2

A hot-dip galvanized steel sheet having a composition containing C: 0.22 mass %, Si: 0.15 mass %, Mn: 2.0 mass %, P: 0.02 mass % or less, S: 0.005 mass % or less, Ti: 0.023 mass %, Al: 0.035 mass %, B: 15 ppm, and N: 50 ppm or less, with the balance being Fe and inevitable impurities and having a 1.6 mm sheet thickness was cut into the shape shown in FIG. 4. It has the size of a 100 mm short side, a 170 mm long side, and a 440 mm height. Next, 0.6 g/$m^2$ blackening in which a 10% nickel chloride hexahydrate aqueous solution was applied, followed by water-washing and drying was applied to a center portion 12 of the hot-dip galvanized steel sheet, thereby forming a portion having reduced reflectance and increased radiant heat transfer efficiency. A peripheral edge portion 13 was not subjected to the blackening.

Next, the hot-dip galvanized steel sheet having undergone the blackening was heated by a near-infrared heating apparatus so that the center portion 12 was quickly heated at a temperature increasing rate of 120° C. per second. At this time, the set temperature was 850° C. As a result, the center portion 12 was heated up to 852° C. but the finally temperature of the peripheral edge portion 13 where radiant heat transfer efficiency was low was 228° C. Then, by a hot stamping apparatus whose forming load was 200 tons, the heated steel sheet was hot-stamped and was quenched in a die as in a conventional manner.

When tensile strength (TS) of the compact was measured, strength (TS) of the center portion 12 of the obtained compact reached 1470 MPa, but strength of the peripheral edge portion 13 was 590 MPa which is substantially the same as that of the hot-dip galvanized steel sheet being the raw material, and thus it was possible to form a portion with different strength in the same component. The compact fabricated in this example is used as a framework component for automobile such as, for example, a center pillar reinforcement, and it is seen from the above result that its high-strength region is a load-burdened region and its peripheral edge portion is excellent in weldability. As described above, the use of the compact fabricated in this example can facilitate spot welding or the like with other components. Further, since the compact fabricated in this example is strengthened only at a required portion, it can have a reduced weight and can be manufactured at low cost.

Figure 9:
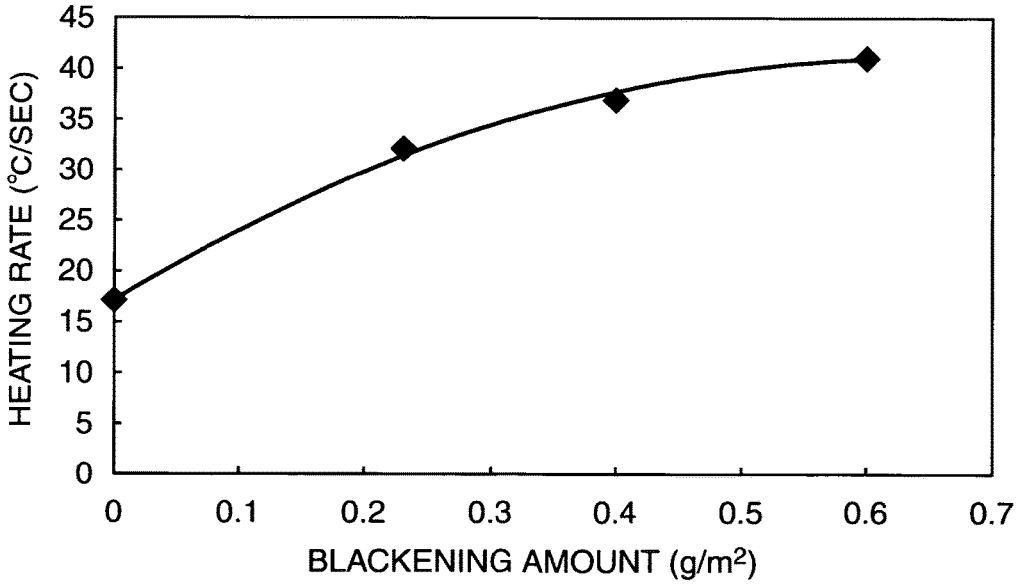
FIG. 9 is a characteristic chart showing a correlation between reflectance treatment depth and heating rate.

FIG. 9 is a characteristic chart showing a correlation between a blackening amount and a heating rate when a metal sheet having undergone blackening as the reflectance reduction in which a 10% nickel chloride hexahydrate aqueous solution was applied, followed by water-washing and drying was heated by a near-infrared ray. As shown in FIG. 9, it is seen that the heating rate improves as the thickness of the blackening is increased. Note that the metal sheet having the characteristic shown in FIG. 9 is a steel sheet having a composition containing C: 0.22 mass %, Si: 0.15 mass %, Mn: 2.0 mass %, P: 0.02 mass % or less, S: 0.005 mass % or less, Ti: 0.023 mass %, Al: 0.035 mass %, B: 15 ppm, and N: 50 ppm or less, with the balance being Fe and inevitable impurities, and its room-temperature strength is 600 MPa.

Example 3

A hot-dip galvanized steel sheet having the same composition as that of the hot-dip galvanized steel sheet used in the example 2 and having a 1.6 mm sheet thickness was cut into the shape shown in FIG. 6. It had the size of a 100 mm short side, a 170 mm long side, and a 440 mm height. Next, a center portion 15 and a peripheral portion 16 of the cut hot-dip galvanized steel sheet were subjected to blackening in which a 10% nickel chloride hexahydrate aqueous solution was applied, followed by water-washing and drying. At this time, the center portion 15 was subjected to 0.6 g/$m^2$ blackening, and the peripheral portion 16 was subjected to 0.3/$m_2$ blackening, thereby forming portions where the reflectance was decreased and radiant heat transfer efficiency was increased as in the shape shown in FIG. 6. A peripheral edge portion 17 was not subjected to the blackening.

Next, the hot-dip galvanized steel sheet having undergone the blackening was heated by a near-infrared heating apparatus so that the center portion 15 was quickly heated at a temperature increasing rate of 120° C. per second. At this time, the set temperature was 850° C. As a result, the center portion 15 was heated up to 852° C. but the peripheral portion 16 where the blackening thickness was smaller than that of the center portion 15 was heated up to 800° C. On the other hand, the finally temperature of the peripheral edge portion 17 where radiant heat transfer efficiency was low was 228° C. Then, by a hot stamping apparatus whose forming load was 200 tons, the heated steel sheet was hot-stamped and was quenched in a die as in a conventional manner.

When tensile strength (TS) of the compact was measured, strength (TS) of the center portion 15 of the obtained compact reached 1470 MPa and strength (TS) of the peripheral portion 16 reached 1000 MPa. On the other hand, strength of the peripheral edge portion 17 was 590 MPa which was substantially the same as that of the hot-dip galvanized steel sheet being the raw material, and thus it was possible to form portions with different strength in the same component. The compact fabricated in this example is used as a framework component for automobile such as, for example, a center pillar reinforcement, and it is seen from the above result that its high-strength region is a load-burdened region and its peripheral edge portion is excellent in weldability. As described above, the use of the compact fabricated in this example can facilitate spot welding or the like with other components. Further, since the compact fabricated in this example is strengthened only at required portions, it can have a reduced weight and can be manufactured at low cost.

Reference Example

Figure 10:
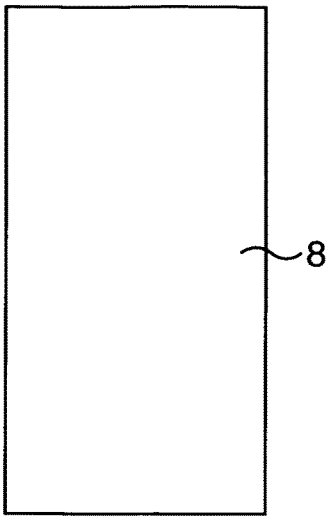
FIG. 10 is a front view showing an example of a metal sheet before it is thermally processed into a metal processed product whose strength is made uniform.

A hot-dip galvanized steel sheet having the same composition as that of the hot-dip galvanized steel sheet used in the example 2 and having a 1.6 mm sheet thickness was cut into the shape shown in FIG. 10. It had the size of a 135 mm width and a 440 mm length. Next, the whole surface of a metal sheet 8 made of the hot-dip galvanized steel sheet was subjected to 0.6 g/m$^2$ blackening in which a 10% nickel chloride hexahydrate aqueous solution was applied for five seconds, followed by water-washing and drying, thereby applying the treatment for reducing reflectance and increasing radiant heat transfer efficiency.

Next, the metal sheet 8 having undergone the blackening was quickly heated at a temperature increasing rate of 120° C. per second by a near-infrared heating apparatus. At this time, the set temperature was 850° C. As a result, the whole surface of the metal sheet 8 was heated up to 852° C. Then, by a hot stamping apparatus whose forming load was 200 tons, the heated steel sheet 8 was hot-stamped and was quenched in a die as in a conventional manner.

When tensile strength (TS) of the compact was measured, strength (TS) of the whole obtained compact reached 1470 MPa. Though a portion with different strength was not formed, the heating was possible at a higher rate than that when the surface of the hot-dip galvanized steel sheet being the raw material was left as it was. The compact fabricated in the reference example is used as a framework component for automobile such as, for example, a side sill. The compact fabricated in the reference example is strengthened over the entire region, can have a reduced weight, and can be manufactured at low cost.

Comparative Example

Figure 11:
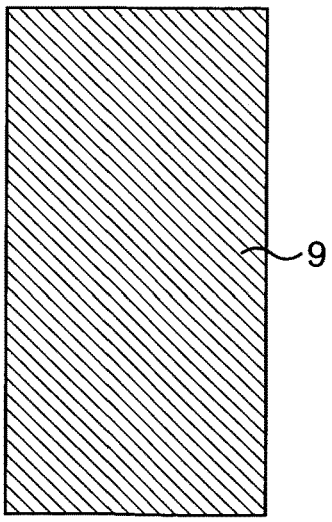
FIG. 11 is a front view showing an example of a metal sheet before it is thermally processed into a metal processed product whose entire strength is uniformly increased.

A hot-dip galvanized steel sheet having the same composition as that in the example 2 and having a 1.6 mm sheet thickness was cut into the shape shown in FIG. 11. It had the size of a 135 mm width and a 440 mm length. Then, a metal sheet 9 was not subjected to blackening for reducing reflectance and was heated under the same conditions as those in the example 2 by a near-infrared heating apparatus. At this time, the set temperature was 850° C. As a result, it took about 2.5 times as long as the time required in the example 2 for the whole surface of the metal sheet 9 to be heated to 852° C. Next, by a hot stamping apparatus whose forming load was 200 tons, the heated steel sheet 9 was hot-stamped and was quenched in a die as in a conventional manner.

When tensile strength (TS) of the compact was measured, the strength (TS) of the whole obtained compact reached 1470 MPa. Though a portion with different strength was not formed, a temperature increase was slow and took a lot of time because the blackening for reducing reflectance was not performed. The compact fabricated in the comparative example is used as a framework component for automobile such as, for example, a side sill. The compact fabricated in the comparative example is entirely strengthened and is capable of having a reduced weight, but is low in productivity and cannot be manufactured at low cost.

INDUSTRIAL APPLICABILITY

According to the present invention, absorptivity for a near-infrared ray is increased at a reflectance-reduced region where reflectance for the near-infrared ray is made lower than that of an original surface of a metal sheet, which can enhance heating efficiency. Therefore, it is possible to intensively heat only a specific portion of the metal sheet by radiant heat transfer at lower cost and with higher productivity than conventionally.

Further, according to another characteristic of the present invention, by subjecting a specific portion of a metal sheet to painting in a blackish color, roughening by blasting, rolling, laser, or the like, metal coating by plating or thermal spraying, coloring and etching by immersion in an acid solution, surface layer quality changing treatment, or the like, it is possible to manufacture the above-described metal sheet that is to be heated by radiant heat transfer, at low cost.

Further, according to another characteristic of the present invention, the treatment in which a portion partially having different radiant heat transfer efficiency is formed on a surface of a metal sheet is combined with the heating by radiant heat transfer, whereby the temperature of the metal sheet is intentionally changed, and thereafter the metal sheet is subjected to thermal processing accompanied by cooling such as hot stamping or quenching, which makes it possible to manufacture a metal processed product having a portion with different strength. By employing painting, roughening by blasting, rolling, laser, or the like, metal coating by plating or thermal spraying, coloring and etching by immersion in an acid solution, surface layer quality changing treatment, or the like, the treatment for thus making radiant heat transfer efficiency partly different on the surface of the metal sheet can be performed at low cost, and therefore does not increase cost much. Further, these treatments can be performed with high productivity and in addition, as a portion where radiant heat transfer efficiency is partially different, an arbitrary position can be selected, which has many advantages such as an increased degree of freedom in component design.

REFERENCE SIGNS LIST

1 metal sheet
2 reflectance-reduced region
11, 14 metal sheet
12, 15 center portion
13, 17 peripheral edge portion
16 peripheral portion

The invention claimed is:

1. A metal sheet comprising a reflectance-reduced region where reflectance for a radiant ray is reduced formed only on a part of a surface of the metal sheet that is to be heated by radiant heat transfer, and wherein the reflectance-reduced region comprises $Al_2O_3$—$TiO_2$-based thermal spray material.

2. The metal sheet according to claim 1, wherein the reflectance of the reflectance-reduced region is 40% or less of radiation directed at the region.

3. The metal sheet according to claim 1, wherein the metal sheet is a plated steel sheet.

4. A metal processed product formed by processing the metal sheet according to claim 1, the metal processed product having a portion with different strength, wherein a portion where reflectance for a radiant ray is reduced is formed only on a part of a surface of the metal processed product, and a difference in Vickers hardness between the portion of the metal processed product where the reflectance for the radiant ray is reduced and the other portion of the metal processed product is HV180 or more, and wherein bending portions are co-existent with the portion where reflectance for the radiant ray is reduced.

5. The metal processed product having the portion with different strength according to claim 4, wherein the difference in Vickers hardness between the portion where the reflectance for the radiant ray is reduced and the other portion is HV200 or more.

* * * * *